United States Patent [19]

von Danwitz

[11] Patent Number: 4,843,807

[45] Date of Patent: Jul. 4, 1989

[54] METHOD OF PRODUCING AN ENDLESS SLING

[75] Inventor: Hans-Otto von Danwitz, Kaarst, Fed. Rep. of Germany

[73] Assignee: Spanset Inter AG, Oetwil am See, Switzerland

[21] Appl. No.: 152,796

[22] Filed: Feb. 5, 1988

[30] Foreign Application Priority Data

Feb. 6, 1987 [DE] Fed. Rep. of Germany ..... 3703547

[51] Int. Cl.[4] ..... B66C 1/12; D07B 1/18; D04C 1/12

[52] U.S. Cl. ..... 57/201; 57/21; 87/6; 87/8; 294/74

[58] Field of Search ..... 57/201, 21; 87/5–9; 294/74–77

[56] References Cited

U.S. PATENT DOCUMENTS

| | | | |
|---|---|---|---|
| 1,312,770 | 8/1919 | Turner et al. | 57/201 X |
| 1,415,696 | 5/1922 | Pierce | 57/21 |
| 1,479,900 | 1/1924 | Dorner et al. | 57/21 |
| 1,588,050 | 6/1926 | Reed | 57/201 |
| 2,753,678 | 7/1956 | Hansen et al. | 57/201 X |
| 3,707,021 | 12/1972 | Norrman | 24/16 R |
| 4,093,292 | 6/1978 | Marcet et al. | 294/74 |
| 4,354,704 | 10/1982 | Mayerjak | 294/74 |
| 4,421,352 | 12/1983 | Raue et al. | 294/74 |

FOREIGN PATENT DOCUMENTS

| | | | |
|---|---|---|---|
| 2716056 | 10/1978 | Fed. Rep. of Germany | 57/21 |
| 2355548 | 9/1979 | Fed. Rep. of Germany . | |

*Primary Examiner*—John Petrakes

*Attorney, Agent, or Firm*—Spencer & Frank

[57] ABSTRACT

A skein of yarn is drawn through a protective tube prefabricated of a woven, tubular textile fabric and is connected in order to form an endless sling. The protective tube is formed of two length sections. These length sections, which are of approximately the same length, are pushed together only slightly during the manufacturing process. In this pushed-together form, they surround the upper reach and the lower reach of the drive formed during drawing in of the skein of yarn by the strands of yarn which are placed around the wheel discs of the manufacturing apparatus.

13 Claims, 4 Drawing Sheets

METHOD OF PRODUCING AN ENDLESS SLING

BACKGROUND OF THE INVENTION

The invention relates to a method of producing an endless sling as used, in particular, for lifting purposes. Such a manufacturing method is the subject matter of DE-A No. 2,716,056.

In such endless slings, the only function of the protective tube composed of a woven, tubular textile fabric is to protect the skein of yarn against external mechanical damage over the entire circumferential length of the sling, since the strands of the skein are generally composed of synthetic yarns. It is known that synthetic threads are particularly susceptible to nicks and cuts.

The protective tube is slightly pushed together in the circumferential direction of the sling. Expansion occurring in the case of load, and thus an increase in the circumferential length of the skein of yarn still does not produce tensile stresses or thus the danger of damage to the protective tube.

A further feature of such endless slings is that the internal cross section of the protective tube composed of a woven, tubular textile fabric is not filled with the skein of yarn to its full capacity but only to about 60% to 70% of the maximum tube cross section. In this way it is ensured that the tube is able to be displaced with respect to the skein of yarn and the individual strands of yarn can easily move relative to one another for automatic load compensation.

The maximum lifetime or service life of such an endless sling is determined primarily by the lifetime or service life of the protective tube. If this tube is damaged somewhere, the endless sling must be discarded for reasons of accident prevention.

A particular feature of the endless sling manufacturing method disclosed in DE-A No. 2,716,056 is that, for introduction of the wound yarn by machine, the one-piece protective tube, which has a greater circumferential length than the skein of yarn, must be pushed together in the longitudinal direction of the tube to a length which is much less than half the initial length of the protective tube.

It is known to increase wear resistance of the protective tube made of a woven, tubular textile fabric by providing it with a greater wall thickness, i.e. to process more textile material. However, the increase in wall thickness of the woven, tubular textile fabric, results in making the prior art manufacturing method more difficult and can therefore be employed only within limits. The greater the wall thickness of the woven, tubular textile fabric, the more difficult it is to push it together in the longitudinal direction of the tube to the required, at least about 40% or even less, of the circumferential length of the skein, without making the reduction of the inner cross section of the protective tube connected therewith more difficult or even impossible. Such increased difficulties arise if the fabric of the tube is reinforced by the addition of wear resistant yarns, e.g. metal yarns, or if a coating is applied. In such cases, the required pushing together of the tubular fabric having the desired wall thickness can be realized only by broadening the tube fabric, i.e. enlarging the tube cross section. Such an enlargement of the tube, however, not only requires the expensive, additional use of textile materials, it also worsens the utility of the endless sling because the protective tube requires an unnecessarily large amount of space in the crane hook. For manipulation of the endless sling during its useful life, a cross-sectional configuration as close to a circle is of advantage because it can then be accommodated in a crane hook with particular ease.

A change has already been made, on the assumption that it would increase the wear resistance of the protective tubes of endless slings, to manufacture a woven, tubular textile fabric having a total of four fabric layers between its two woven selvages so that the skein of yarn placed therebetween is protected against the exterior on both sides by two layers of fabric between the two selvages. Although this type of construction of the tube fabric may facilitate its being pushed together for insertion of the skein of yarn, it has been found that endless slings equipped with such protective tubes are particularly prone to accidents.

The regular checking of endless slings in use is directed primarily toward damage of the tube fabric, i.e. that there is no penetration to the supporting skein of yarn as a result of external mechanical influences. Such penetrations can easily be detected from the outside at protective tubes having only one layer of fabric between the selvages of the tube fabric. But if a tube wall is formed of a double layer of fabric between the selvages of the protective tube, there exists the danger that, for example, sharp metal chips penetrate initially only the outer layer of fabric; due to the fact that the inner layer of fabric remains undamaged in the penetration region, this cannot be detected externally or only with relative difficulty. The penetrated metal chips then travel between the outer and inner layers of the protective tube fabric and cannot be seen from the outside. This travel occurs completely unimpededly. If then these metal chips, which roam around, so to speak, between the outer and inner layers of the protective tube fabric, some where also penetrate the inner layer of the fabric, damage the skein of yarn can occur. This reduces the maximum load the lifting sling is able to support, and this cannot be detected from the outside by normal, optical checking of the endless sling or, more precisely, of the protective tube of the endless sling.

SUMMARY OF THE INVENTION

It is the object of the invention to provide a manufacturing method of the above-mentioned type with which the wall thickness of the two fabric layers of the tube fabric can be increased substantially as desired without excessive costs for textile materials. Briefly, the solution resides in that the total length of the protective tube is divided into two preferably equal-length length sections of tube fabric before the skein of yarn is inserted in the conventional manner. This division into two length sections has the advantage that the tube fabric need no longer be pushed together longitudinally, in the region of the two length sections, to a minimum of about 40%, but now only to about 80% to 90% of its initial length to be able to insert the skein of yarn by machine in the conventional manner. This slight amount of pushing together makes it possible to considerably increase the textile wall thickness of both fabric layers of the tube fabric without having to increase, solely for production engineering reasons, the width of the tube fabric and thus its available cross-sectional area to enable it to accommodate a skein having the same load carrying capability. This process also does not require any significant additional apparatus expenditures. In the end result, the endless sling produced according to the invention differs from a conventional endless sling of the above-mentioned type, except for the additional wall thickness of both fabric layers of the tube fabric, only by the fact that the protective tube is not composed of a single piece of tube fabric but of two tube fabric pieces placed end to end in the circumferential direction, with their ends being connected to one another, particularly sewn together.

BRIEF DESCRIPTION OF THE DRAWINGS

The manufacturing method and the endless sling according to the invention will be described in greater detail with reference to the drawing figures, in which.

DETAILED DESCRIPTION OF THE PREFERRED EMBODIMENT

Figures 1, 1A:
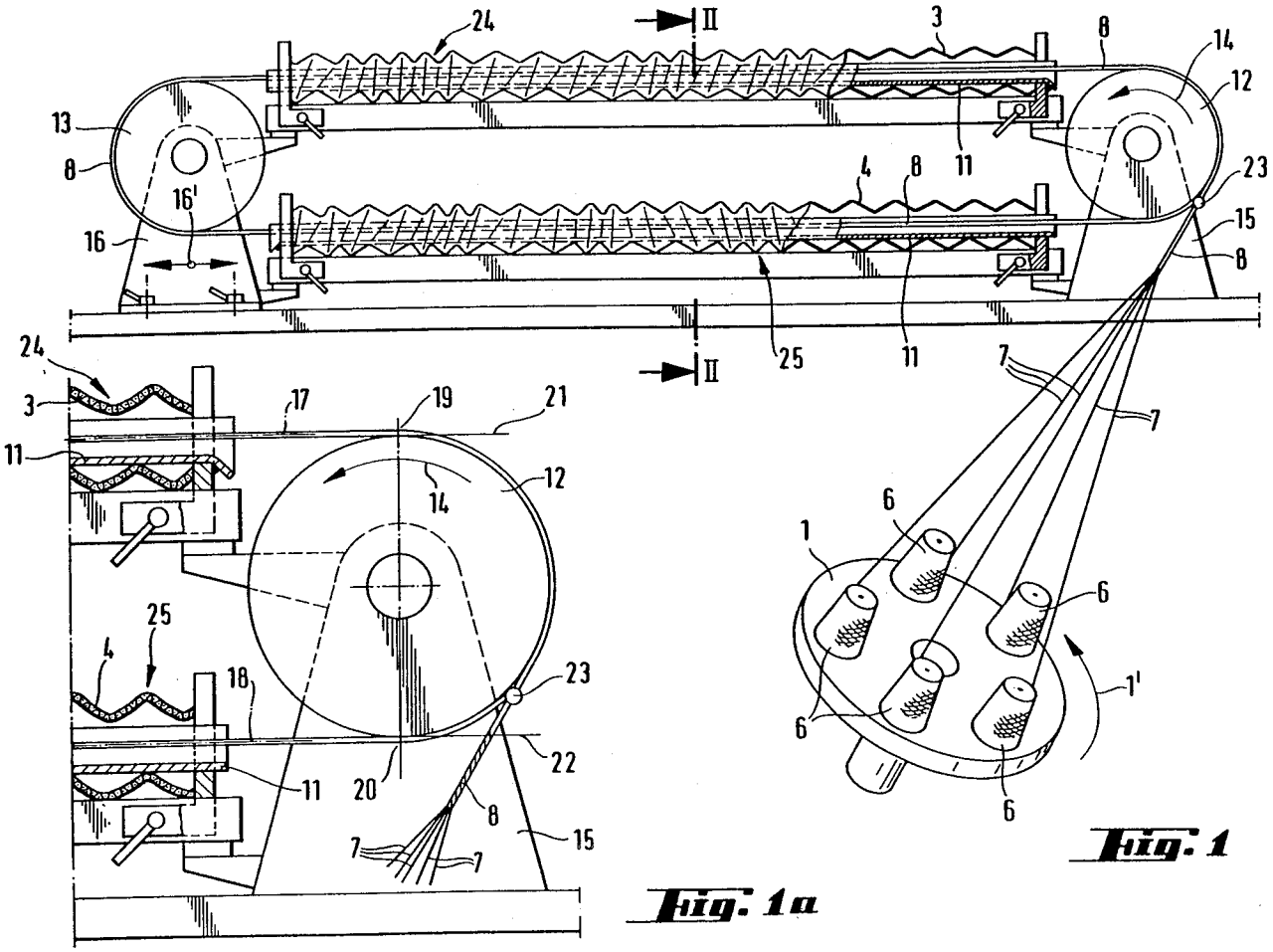
FIG. 1 is a schematic illustration of a device for implementing the method.
FIG. 1*a* is an enlarged sectional detail view of FIG. 1.
Figure 2:
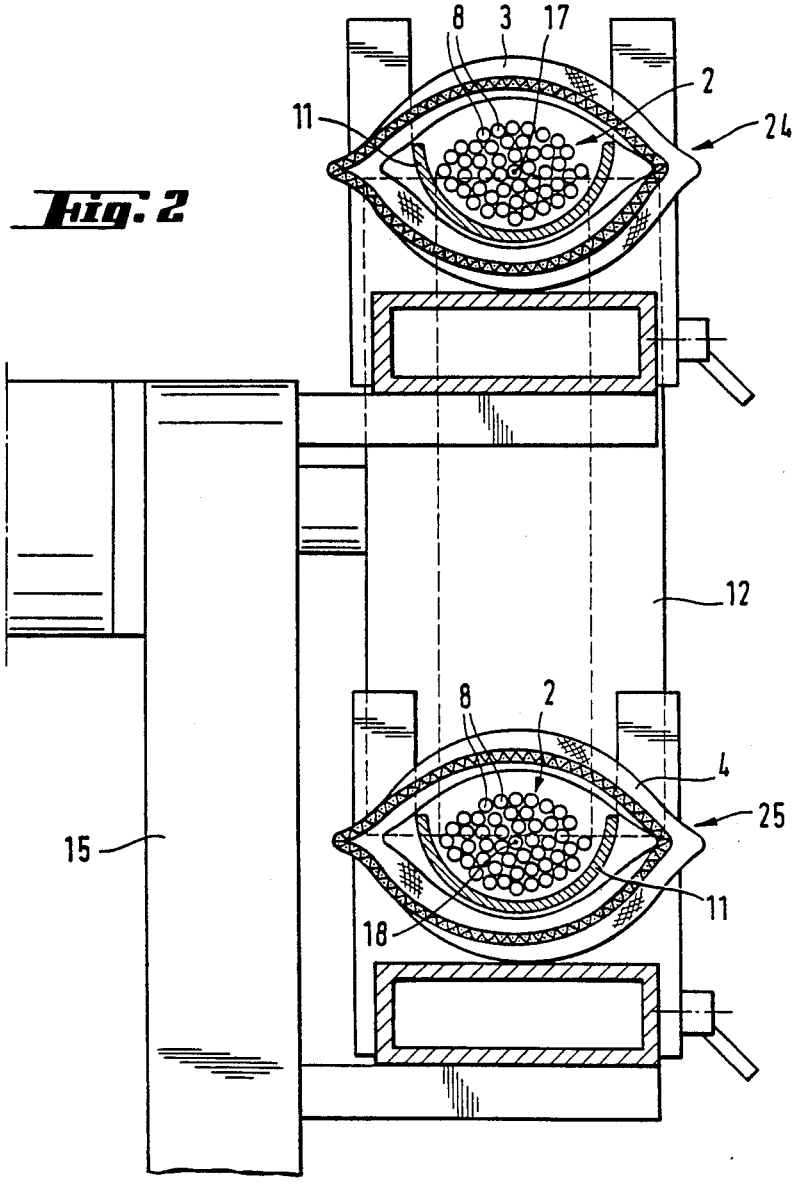
FIG. 2 is a sectional view along line II—II of FIG. 1 of the pushed-together length sections of the tube with inserted skein of yarn.
Figure 3:
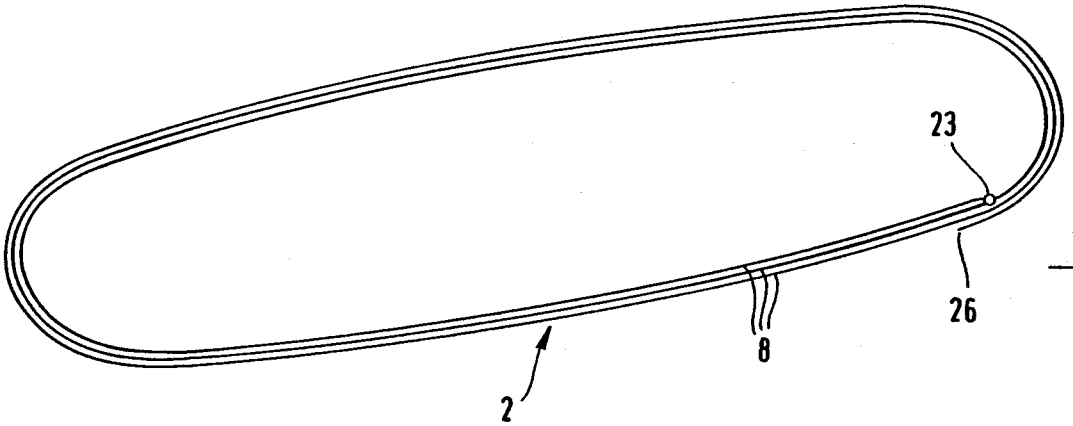
FIG. 3 is a schematic representation of the naked skein of yarn which, for reasons of clarity, is here composed of only three turns.
Figure 4:
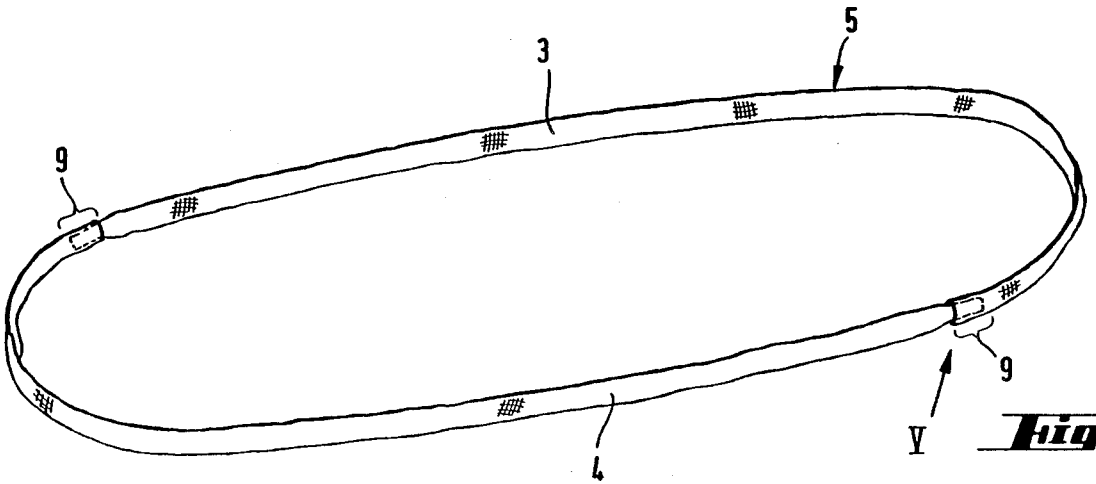
FIG. 4 is a view to a smaller scale of the finished endless sling.
Figure 5:
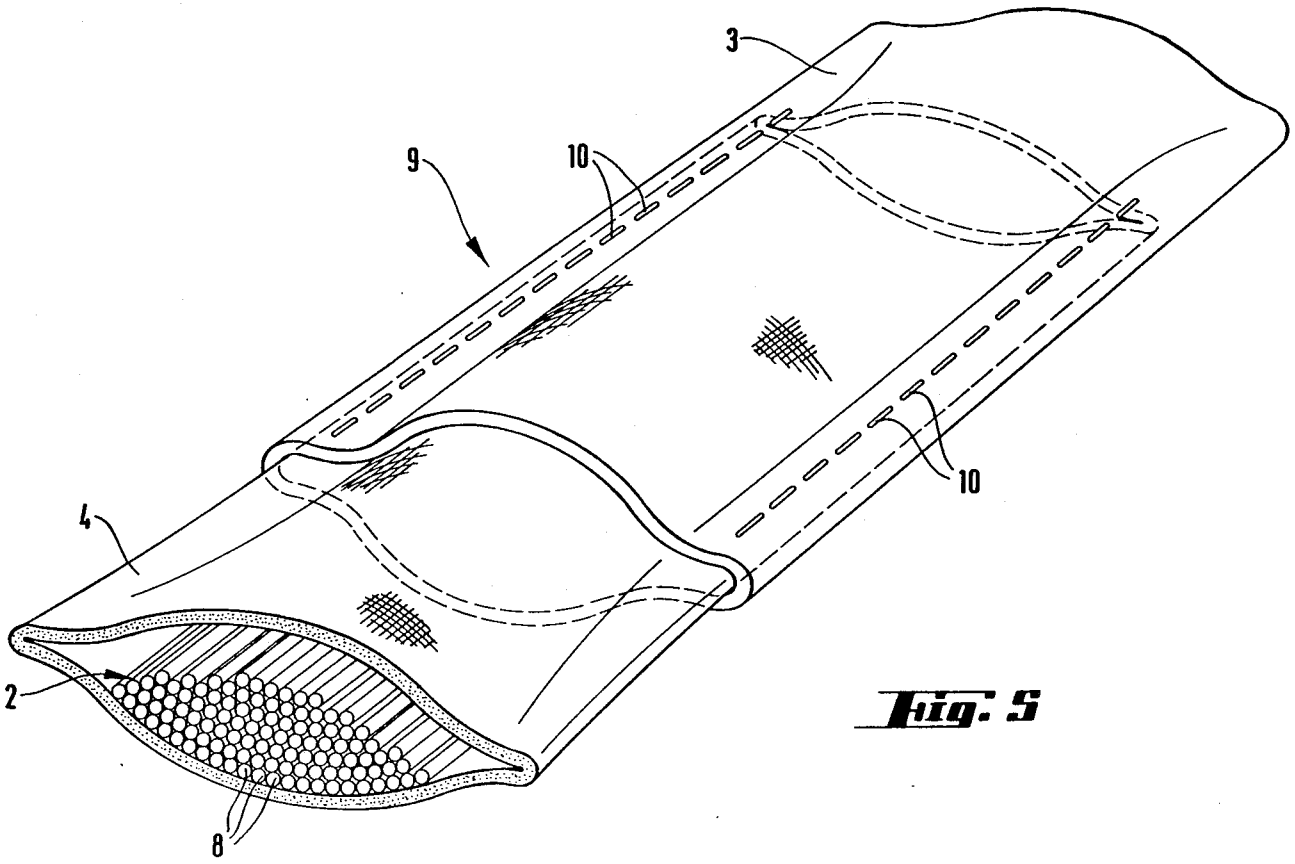
FIG. 5 is an enlarged schematic illustration of the overlap region of the length sections of the protective tube seen in the direction of arrow V of FIG. 4.

The bobbin table 1 of the apparatus for introducing a skein of loosely laid yarn 2 into length sections 3 and 4 of the protective tube 5 of the endless sling (FIG. 4) is equipped with a plurality of synthetic filaments 7 wound on bobbins 6. Filaments 7 may be twisted together into a strand of yarn 8 by rotation of bobbin table 1 in the direction of arrow 1'. Yarn strand 8 may also be called a ply. The length sections 3 and 4 of protective tube 5 are cut off from a woven tube fabric of any desired length. The length of sections 3 and 4 corresponds to somewhat more than half of the circumferential length of the endless sling of FIG. 4 plus an extra amount for the mutual overlap 9 in the region of their ends. In the region of the overlap 9 of the ends of the two length sections 3 and 4 of protective tube 5, when the endless sling is finished, there is provided a seam 10 which prevents the two length sections 3 and 4 from coming apart to thus expose the skein of yarn.

The two length sections 3 and 4 are each pushed in the longitudinal direction of the tube over a trough-like supporting element 11. Supporting element 11 has about the cross-sectional shape of a tube cut in half in the longitudinal direction. In the longitudinal direction of supporting element 11, length sections 3 and 4 of supporting tube 5 are pushed together in such a manner that their pushed-together length is about 80% to 90% of their initial length of tubular fabric. The length of supporting element 11 corresponds approximately to the pushed-together length of the two length sections 3 and 4.

Then, both supporting elements 11 with length sections 3 and 4 surrounding them are brought between two wheel discs 12 and 13. The planes of rotation of wheel discs 12 and 13 lie in the same vertical plane.

Wheel disc 12 may be driven by a motor in the direction of arrow 14. It is mounted to the machine frame in a stationary manner as indicated by a bearing arm 15.

Wheel disc 13 is mounted to be freely rotatable only at bearing arm 16. Bearing arm 16 is mounted in the machine frame to be displaced to both sides in the direction of arrow 16'. In this way it is possible to vary the distance between the two wheel discs 12 and 13. This distance, together with the diameter of the two wheel discs 12 and 13, determines the desired circumferential length of the endless sling to be produced. Wheel discs 12 and 13 may be mounted on one side in order to facilitate removal of skein of yarn 2 from wheel discs 12 and 13 after skein of yarn 2 has been drawn into the two length sections 3 and 4 of the future protective tube 5.

For insertion of a skein of yarn 2 into the two length sections 3 and 4 of the future protective tube, the two supporting elements 11 together with the pushed-together length sections 3 and 4, respectively, pushed thereonto are arranged in the longitudinal direction within the vertical plane defined by the plane of wheel discs 12 and 13 in such a manner that the longitudinal center axes 17 and 18 of the two semi-tubular supporting elements 11 and the length sections 3 and 4 seated thereon in a pushed-together form approximately coincide with the tangents 21 and 22 placed respectively through the zenith 19 and the nadir 20 of the two wheel discs 12 and 13. In this way, the first length section 3 encloses the upper reach 24 and the second length section 4 encloses the lower reach 25 of the strand of yarn drive.

Then strand of yarn 8 is brought around the circumference of right-hand wheel disc 12 through supporting element 11 and the first length section 3 which has been pushed onto the latter in a shrunken form, from the top to the bottom over the circumference of left-hand wheel disc 13 and from there in the reverse direction through supporting element 11 with the second length section 4 placed thereon in a pushed-together form and back again to wheel disc 12. Then this end of strand of yarn 8 is knotted by means of a knot 23 to the strand coming from bobbin table 1. With this knotted connection, strand of yarn 8 now forms a type of closed drive between the two wheel discs 12 and 13. The knotted connection of the ends of strand of yarn 8 to form this drive must be made in such a manner that strand of yarn 8 rests relatively firmly on the circumference of wheel discs 12 and 13 so that a friction lock exists with respect to wheel discs 12 and 13. The only significant fact is the production of a closed drive and not the number of wheel discs 12 and 13 of this drive. It is quite conceivable to operate, instead of With only two wheel discs—as in the embodiment, —with a drive which includes four wheel discs in which then each wheel disc causes a turn of only about 90°. Such a structural configuration of the manufacturing apparatus may be advantageous for reasons of friction.

Now the drive of wheel disc 12 is turned on in the direction of arrow 14. This causes a twisted strand of yarn 8 formed from filaments 7 drawn from bobbin table 1 to be pulled through the pushed-together length sections 3 and 4 of the future protective tube 5. Each full revolution of knot 23 indicates that a further strand of yarn has been pulled through the two pushed-together length sections 3 and 4 of the future protective tube 5.

Consequently, the number of revolutions of knot 23 corresponds to the number of turns of yarn 8 in the future skein of yarn 2 to be disposed within the two length sections 3 and 4.

After the desired number of revolutions of knot 23 has been reached, the drive for wheel disc 12 is turned off, which may be effected by means of an automatic control device. Then the rear end 26 of strand of yarn 8 is cut from the intake side of filaments 7. Thereafter, the skein 2 composed of a plurality of wound strands of yarn is removed from wheel discs 12 and 13. Supporting elements 11 are then pulled out of the pushed-together length sections 3 and 4 of the future tubular sleeve 5. Length sections 3 and 4 are pulled apart to their original starting length in the circumferential direction of skein 2. The ends of length sections 3 and 4 are pushed into one another in order to form the overlap 9 and are connected together by a seam 10.

The manufacturing method according to the invention makes it possible, without changing the width of the tubular fabric or the inner cross section of the protective tube intended to accommodate skein 2, to configure the tubular fabric, e.g. to increase its wear resistance, so that it need be pushed together to a lesser degree than is necessary in the prior art manufacturing method.

It will be understood that the above description of the present invention is susceptible to various modifications, changes and adaptations, and the same are intended to be comprehended within the meaning and range of equivalents of the appended claims.

What is claimed is:

1. A method of producing an endless sling composed of a supporting core made of a skein of yarn, and protective tube made of a woven fabric surrounding the skein of yarn, said protective tube comprising two length sections, and the method comprising the steps of:

compressing each respective length section;

pulling a strand of yarn through each of the length sections which have been compressed;

placing the regions of the strand of yarn which project from the ends of each of the length sections over the circumference of respective wheel discs;

attaching the free end of the strand with a region of the strand which has not been pulled through the length sections so as to form a continuous strand loop around the wheel discs such that each of the length sections surrounds a different reach of the loop for pulling in the skein of yarn;

rotating one wheel disc to cause the loop to rotate so that the region of the strand of yarn not yet pulled through the length sections is continuously pulled therethrough thereby allowing a plurality of individual strands to pass through each of the respective length sections;

removing the length sections and the plurality of strands of yarn passing therethrough from the wheel discs; and connecting the ends of the length sections together so as to form a continuous protective tube.

2. A method for producing an endless sling as defined in claim 1, wherein said protective tube includes two layers of fabric between its selvages.

3. A method for producing an endless sling as defined in claim 1, wherein said step of connecting the ends of the length sections together is accomplished by sewing.

4. An endless sling made according to the method of claim 1, wherein said woven fabric has a wall thickness, consistency and width such that when the ends of each of said length sections are pushed together to less than about 50% of the initial length of said tube, said step of pulling a strand of yarn through each of the length sections is substantially prevented due to the insufficient size of the inner cross section of said tube resulting from the ends being pushed together.

5. An endless sling as defined in claim 4, wherein said protective tube includes two layers of fabric between its selvages.

6. An endless sling as defined in claim 4, wherein said two length sections are sewn together at their ends.

7. An endless sling as defined in claim 4, wherein said woven fabric is made of textile.

8. An endless sling as defined in claim 4, wherein said length sections have approximately the same length.

9. An endless sling as defined in claim 4, wherein said woven fabric is reinforced.

10. An endless sling as defined in claim 9, wherein said woven fabric is reinforced by wear resistant threads.

11. An endless sling as defined in claim 10, wherein said wear resistant threads are metal.

12. An endless sling as defined in claim 9, wherein said woven fabric is reinforced by an added coating.

13. A method as defined in claim 1, wherein said step of compressing compresses each said respective length section to approximately 80–90% of its uncompressed length.

* * * * *